United States Patent [19]

Selvin et al.

[11] Patent Number: 4,613,198

[45] Date of Patent: Sep. 23, 1986

[54] ELECTRICAL CONNECTOR BACKSHELL

[75] Inventors: Gerald J. Selvin, Huntington Beach; Hermenegildo A. Espiritu, Cerritos, both of Calif.

[73] Assignee: International Telephone & Telegraph Corporation, New York, N.Y.

[21] Appl. No.: 548,819

[22] Filed: Nov. 4, 1983

[51] Int. Cl.[4] ..... H01R 13/46

[52] U.S. Cl. ..... 339/141; 339/138

[58] Field of Search ..... 339/89 R, 89 C, 89 M, 339/90 R, 91 B, 103 R, 103 M, 136 R, 136 M, 138, 141

[56] References Cited

U.S. PATENT DOCUMENTS

| | | | |
|---|---|---|---|
| 2,286,952 | 6/1942 | Cannon et al. | 339/89 M |
| 2,374,971 | 5/1945 | Benander | 339/141 |
| 2,420,826 | 5/1947 | Irrgang | 174/153 |
| 2,424,759 | 7/1947 | Klumpp, Jr. | 174/153 |
| 2,829,358 | 4/1958 | Testori | 339/89 M |
| 2,913,791 | 11/1959 | Martin | 24/126 |
| 2,968,851 | 1/1961 | Hardy | 24/135 |
| 2,974,186 | 3/1961 | Klumpp, Jr. | 174/153 |
| 3,014,194 | 12/1961 | Berglund | 339/75 |
| 3,076,655 | 2/1963 | Washburn, Jr. | 277/4 |
| 3,141,062 | 7/1964 | Rapata | 174/153 |
| 3,249,687 | 5/1966 | Klumpp, Jr. | 174/153 |
| 3,424,856 | 1/1969 | Coldren | 174/153 |
| 3,546,658 | 12/1970 | Van Horssen et al. | 339/90 R |
| 3,659,251 | 4/1972 | Fish | 339/141 X |
| 3,751,579 | 8/1973 | Nojiri | 174/153 |
| 3,755,615 | 8/1973 | Paullus et al. | 174/76 |
| 3,848,950 | 11/1979 | McCormick et al. | 339/90 R |
| 4,002,821 | 1/1977 | Satoh et al. | 174/153 |
| 4,002,822 | 1/1977 | Kurosaki | 174/153 |
| 4,077,085 | 3/1978 | Yuda | 16/2 |
| 4,142,064 | 2/1979 | Thomsen | 174/153 |
| 4,143,934 | 3/1979 | Siebert | 339/75 |
| 4,422,710 | 12/1983 | Perona | 339/89 M X |

FOREIGN PATENT DOCUMENTS 1503259 3/1978 United Kingdom .

OTHER PUBLICATIONS

"Approaches to EMI Control in Digital Data Transmission Systems," by John Landis-AMP Incorporated, *Fifteenth Annual Connectors and Interconnection Technology Symposium Proceedings*, published by Electronic Connector Study Group, Inc.

*Primary Examiner*—Eugene F. Desmond

*Attorney, Agent, or Firm*—T. L. Peterson; R. C. Turner

[57] ABSTRACT

An electrical connector backshell which is divided longitudinally into a pair of separable parts. The longitudinal edges of the two parts embody interlocking means allowing longitudinal sliding engagement of the parts, but preventing lateral separation of the parts even if one or both of the parts is flexed. The backshell housing may be formed from sheet metal. The two parts of the housing may be assembled over a cable after the conductors thereof have been connected to the contacts in a connector shell.

11 Claims, 20 Drawing Figures

ELECTRICAL CONNECTOR BACKSHELL

BACKGROUND OF THE INVENTION

The present invention relates generally to electrical connectors and, more particularly, to a backshell for electrical connectors.

It is common to utilize a backshell on an electrical connector to protect the wires of the electrical cable which are connected to the contacts in the connector shell and to prevent dust, particles and moisture from entering the rear of the connector. The backshell provides strain relief for the cable so that excessive forces applied to the cable will not cause the wires thereof to become disconnected from the contacts in the connector shell.

Almost all connector backshells used in the industry today consist of a cast or otherwise formed rear cable support structure and a coupling ring to lock this rear structure to the connector shell. Particularly in circular connectors, where cabling and harness work must be performed, these two parts can become troublesome to handle and may be relatively expensive.

It is normally essential that both the cable support structure and locking ring be passed onto the cable before individual contacts are inserted into the rear of the connector shell. In many cabling and harnessing assembly operations this can be troublesome because the length and bulk of these mechanical parts prethreaded onto the cable can get in the way when the conductor run of the cable is dense, or short, or requires a sharp bend. It would be desirable if the connector backshell parts could be kept away from the cable and harness, and not installed until all the connector contacts have been inserted into the connector. This feature would be even more desirable when it is necessary to remove a backshell and get at a particular contact in the connector for service in the field.

One approach for solving this problem is disclosed in co-pending application of H. A. Espiritu entitled "Electrical Connector Endbell," Ser. No. 457,849, filed Jan. 14, 1983, assigned to the same assignee as the present application. Espiritu teaches a molded plastic backshell in which a longitudinally extending slot is formed in the wall of the backshell housing which is dimensioned to allow the cable of a harness assembly to be pushed laterally through the slot into the interior of the housing. After the backshell housing is installed over the cable, a cover is installed on the housing to close the slot. The cover embodies longitudinally extending tongues which extend into complementary grooves formed in the sides of the slot. The forward end of the housing and the cover are threaded so that the assembly may be threadedly engaged as a unit with the shell of the connector. Thus, no separate clamping ring is required. Thus, the backshell need not be installed until after the connector is completely terminated, thus allowing the backshell to be kept away from the cable and harness while installing all the connector contacts into the connector shell. The molds required for forming the Espiritu backshell are relatively expensive, thus adding to the cost of the backshell. Also, the backshell is relatively bulkly, which adds weight to the overall connector assembly.

It is the object of the present invention to provide a backshell for a connector which does not have to be installed until after the connector is completely terminated, yet is inexpensive to manufacture and is relatively lightweight, particularly as compared to the standard cast backshells utilized in the industry today.

SUMMARY OF THE INVENTION

According to a principal aspect of the present invention, there is provided a backshell comprising a hollow housing which is divided longitudinally into a pair of separable parts. The adjacent longitudinally extending edges of the parts embody interlocking means allowing longitudinal sliding engagement of the two parts, but preventing lateral separation of the parts even if one or both of the parts is flexed. The two parts of the backshell housing may be assembled over the cable onto the back of the connector shell after the connector has been completely terminated. The two parts slidably lock one to the other and can be pushed forward until they contact the rear of the connector shell. A coupling ring, which is initially installed on the cable prior to termination of the conductors to the connector, may then be brought up over the backshell to clamp it onto the connector shell. Thus, all that is necessary to permanently apply on the cable before terminating the wires to the connnector is the backshell clamping ring. The ring is usually small and does not get in the way during cabling or service operations. The backshell parts may be formed by economic stamping and forming operations rather than the more conventional casting and machining operations utilized for cast backshells which are commonly in use. Thus, the cost of manufacture of the backshell of the present invention is relatively low. Furthermore, since the backshell is formed of thin sheet material, it will have relatively light weight as compared to standard cast metal backshells, or even a plastic backshell as disclosed in the aforementioned Espiritu application. The backshell of the invention may also be provided with a split elbow which may be installed on the backshell after termination of the cable conductors to the connector and which allows the cable to be directed away from the connector at an angle with respect to the longitudinal axis thereof.

DESCRIPTION OF THE PREFERRED EMBODIMENTS

Figure 1:
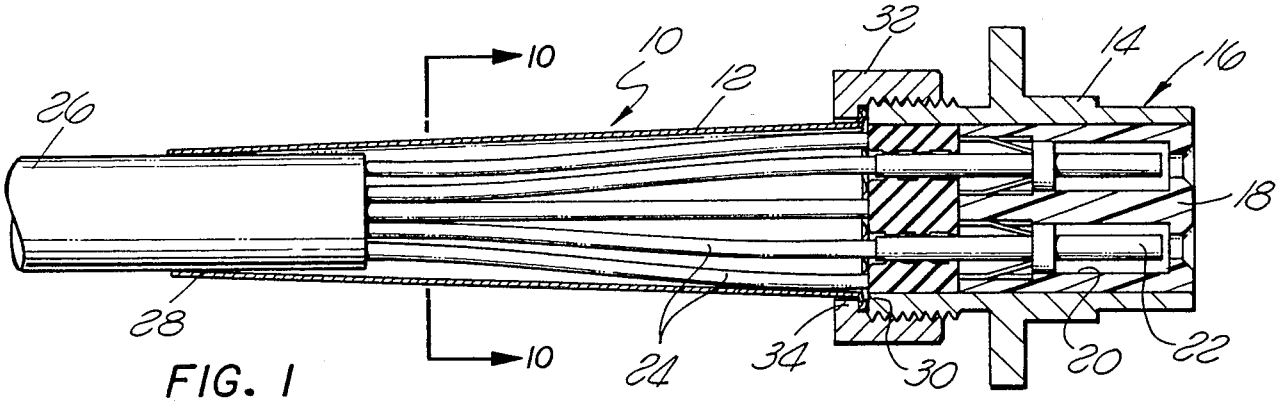
FIG. 1 is a partial longitudinal sectional view of a connector assembly having one form of the backshell of the present invention mounted on a connector member, with a cable shown extending through the backshell with its conductors terminated to the contacts in the connector member.

Reference is now made to the drawings in detail, wherein FIGS. 1 to 10 illustrate one embodiment of the backshell of the present invention, generally designated 10. The backshell comprises a frusto-conical shaped hollow housing 12 which is mounted against the rear of the shell 14 of an electrical connector member 16. The connector member contains an insulator 18 having a plurality of longitudinally extending contact cavities 20 formed therein, only two being shown in FIG. 1 for purposes of illustration. A contact 22 is mounted in each of the cavities. Each contact is connected to the conductor 24 of a cable 26 which extends through the rear 28 of the backshell. The backshell housing 12 is formed with an outwardly extending annular flange 30 at its forward end which abuts against the rear end of the connector shell 14. A coupling ring 32 is mounted over the backshell. The ring has an inwardly extending flange 34 at the rear thereof which abuts against the flange on the backshell so that when the ring is threaded onto the rear of the connector shell 14, the backshell flange will be clamped between the flange 34 and the shell 14.

Figure 2:
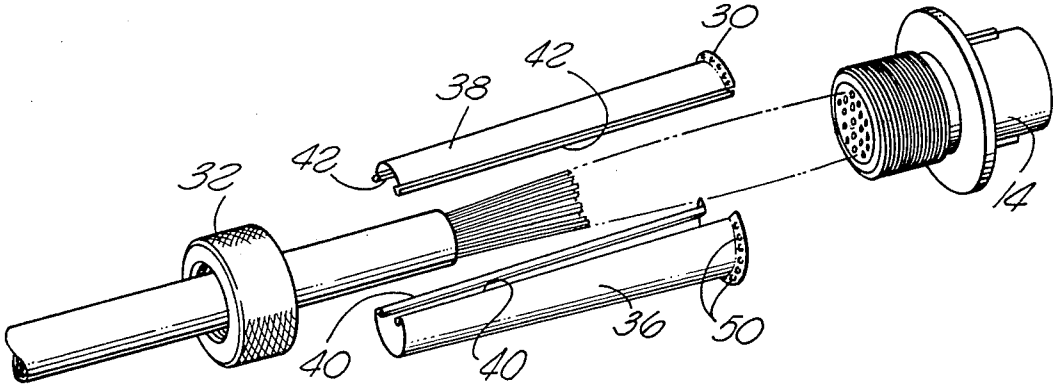
FIG. 2 is an exploded view of the connector assembly illustrated in FIG. 1.

According to the invention, the backshell housing is divided longitudinally into a pair of separable parts, as best seen in FIG. 2. One of the parts 36 may be referred to as being a body, and the other part 38 the cover for the body. The body 38 has a greater arcuate dimension than the cover. The body and cover may be formed by stamping and forming sheet metal.

The body 36 embodies two longitudinally extending parallel edges 40 which are adjacent to the longitudinally extending parallel edges 42 on the cover 48 when the cover is mounted on the body.

The pairs of adjacent edges 40 and 42 on the body and cover of the backshell housing embody interlocking means, generally designated 44, which allow longitudinal sliding engagement and thus assembly of the cover to the body, but prevent lateral separation of the two parts even if one or both of the parts is flexed, which may occur since the parts are formed of resilient material. The interlocking means may best be seen in FIGS. 4, 5, 7, 8 and 10. As shown in such Figs. the edges 42 of the cover are rolled back to form longitudinally extending channels 46. The edges 40 of the body 36 are likewise rolled back to form rails 48 which have a relatively close sliding fit within the channels 46. The rolled edges of the cover forming the channel 46 and the rolled edges of the body forming the rails 48 extend inwardly into the interior of the housing 12 so that the outer surface of the housing is substantially smooth and therefore devoid of outward projections at the edges. As can be seen in FIG. 11, the cross-section of the housing is substantially a circle and the looped edges are bent inwardly.

Figure 3:
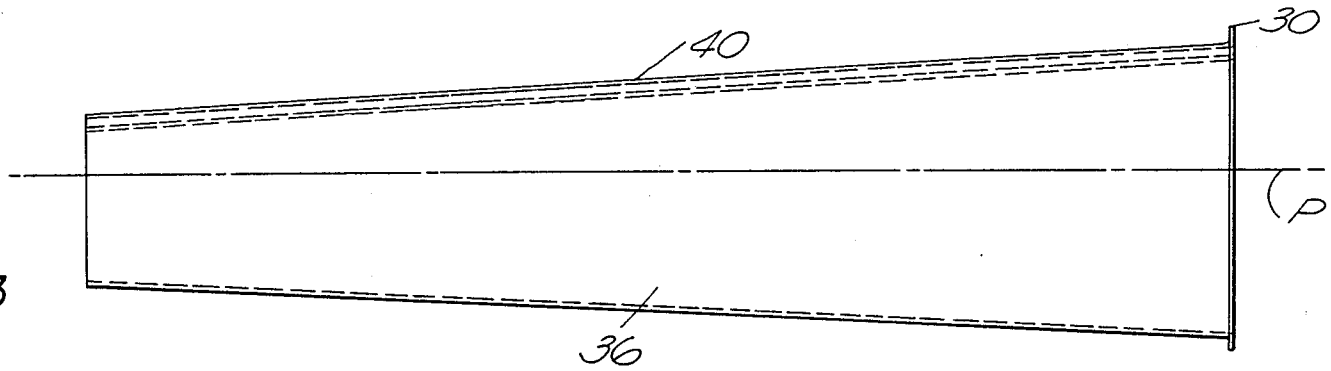
FIG. 3 is a side view of one part, the body, of the backshell housing illustrated in FIGS. 1 and 2.
Figure 5:
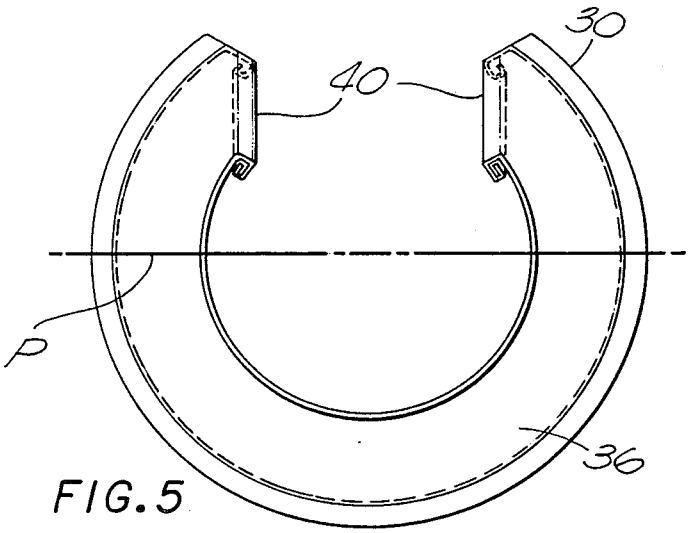
FIG. 5 is a rear view of the body illustrated in FIG. 3.
Figure 4:
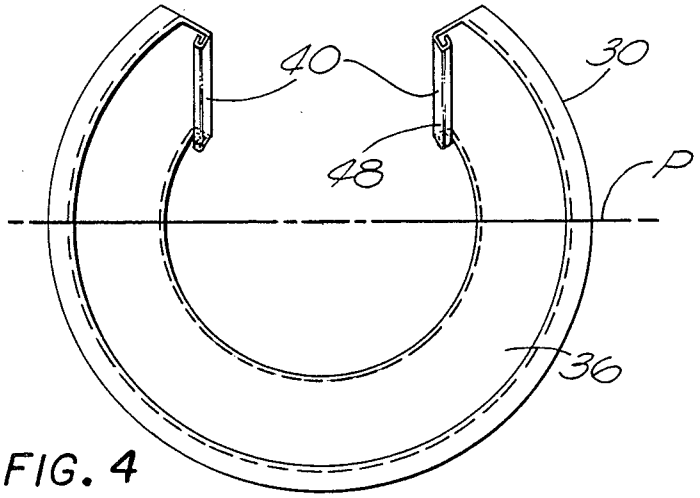
FIG. 4 is a front view of the body illustrated in FIG. 3.
Figure 6:
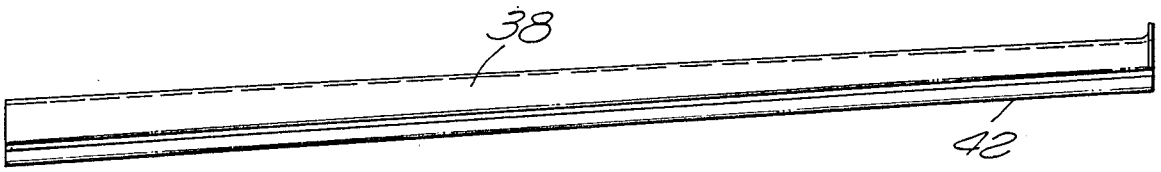
FIG. 6 is a side view of the other part, the cover, of the backshell housing illustrated in FIGS. 1 and 2.
Figure 8:
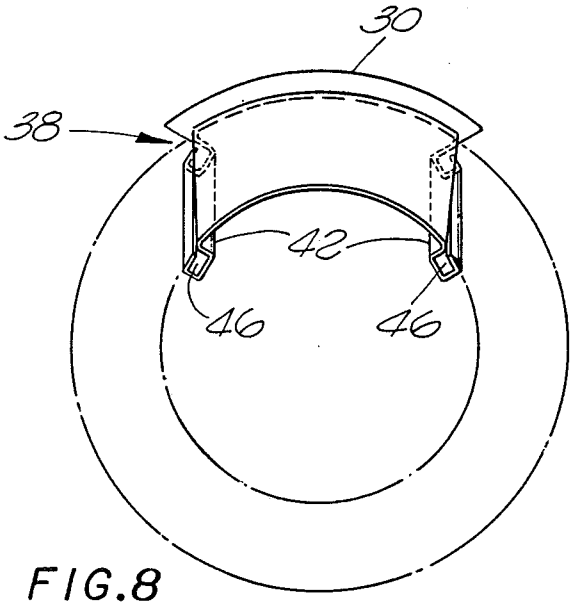
FIG. 8 is a rear view of the cover illustrated in FIG. 6.
Figure 7:
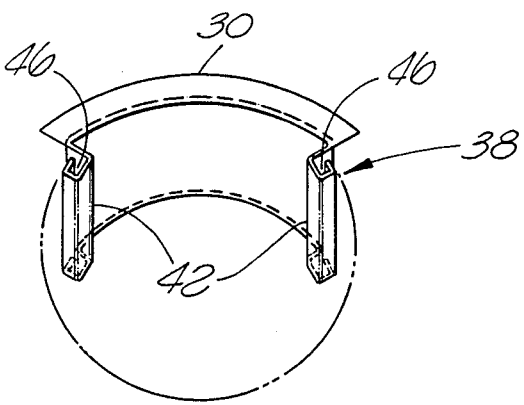
FIG. 7 is a front view of the cover illustrated in FIG. 6.
Figure 9:
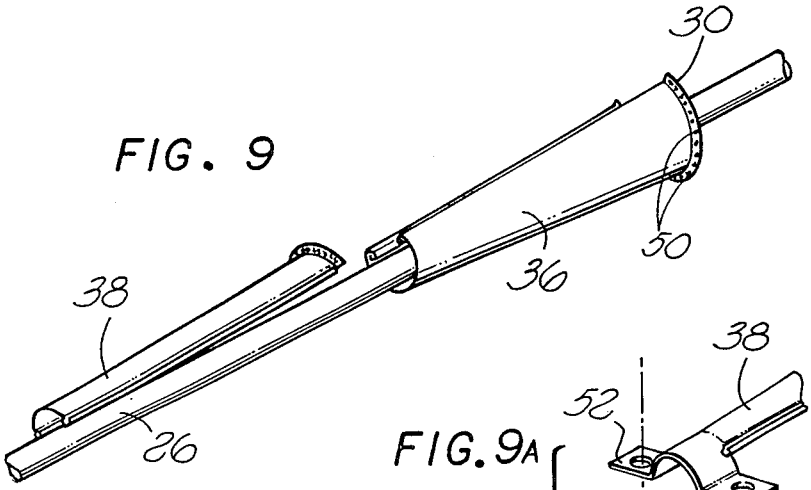
FIG. 9 is an exploded view of the two parts of the backshell housing, with the cover shown in position for sliding engagement with the body.

To form the assembly illustrated in FIG. 1, initially the coupling ring 32 is threaded over the cable 26. Then the conductors 24 of the cable are terminated to the contacts 22, and the contacts are inserted into the cavities 20 in the insulator 18 of the connector member 16. The cover 38 and body 36 are then positioned relative to each other around the cable 26 essentially as shown in FIG. 9. As seen in FIGS. 3 and 5 the longitudinally extending edges 40 of the body 36 extend at an acute angle with respect to a horizontal plane P which passes through the center axis of the body. The cover 38 is disposed at the same angle behind the body 36 with its edges 42 aligned with the edges 40 so that when the cover is pushed forwardly the rails 48 on the body will slidably receive the channels 46 formed by the rolled over edges of the cover. The cover is pushed forwardly until its forward end is aligned with the forward end of the body 36. The thus formed hollow backshell is then pushed forwardly against the connector shell 14 so that the flange 30 will engage the rear of the shell. The coupling ring 32 is then shifted forwardly over the backshell and is threaded onto the rear of the connector shell 14 as illustrated in FIG. 1 to complete the assembly. While the coupling ring has been illustrated as being a one-piece ring, it could be a two-piece structure similar to that disclosed in the aforementioned Espiritu application which may be installed around the cable after the connector contacts are terminated to the cable conductors.

It is noted that the rolled over edges of the cover 38 and body 36 which form the interlocking arrangement between the two parts are bent into a substantially closed loop configuration to maximize the amount of surface area of the two parts which engage each other, thereby providing an environmental seal and EMI/RFI shielding for the interior of the backshell.

Figure 9A:
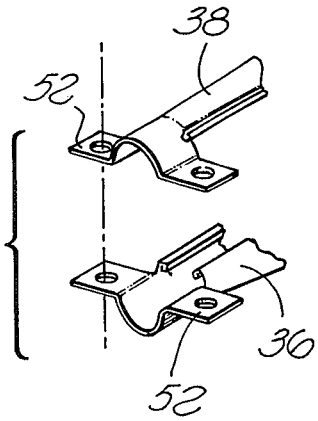
FIG. 9*a* is an exploded view of an alternative form of the rear portions of the backshell housing parts, embodying cable clamp flanges.

The front face of the flange 30 of the backshell housing may be formed with dimples or serrations 50 which engage the rear of the connector shell 14 to prevent rotation of the backshell housing relative to the shell 14 when the clamping ring 32 is threaded onto the connector shell. Furthermore, as seen in FIG. 9*a* the rear portions of the cover 38 and body 36 may be formed with cable clamp flanges 52 for tightly securing the cable within the rear of the backshell housing.

Figure 10:
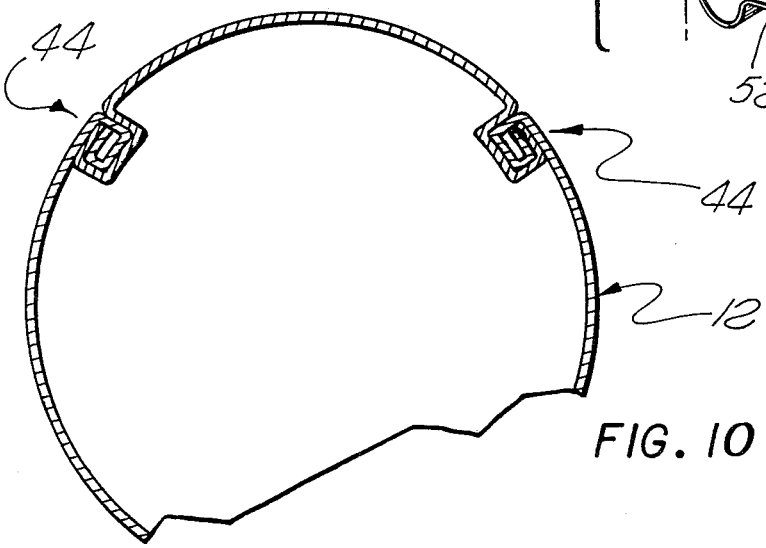
FIG. 10 is a transverse sectional view taken along line 10—10 of FIG. 1 showing how the cover and body of the backshell housing are interlocked.
Figure 11:
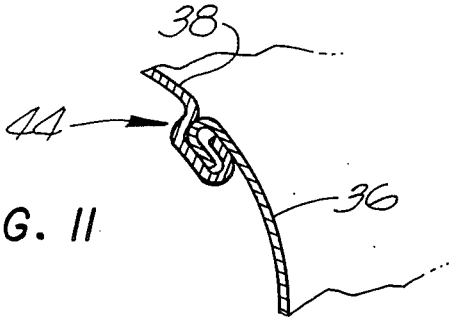
FIG. 11 is a fragmentary transverse sectional view showing an alternative form of interlocking means which may be utilized between the cover and the body of the backshell housing.
Figure 12:
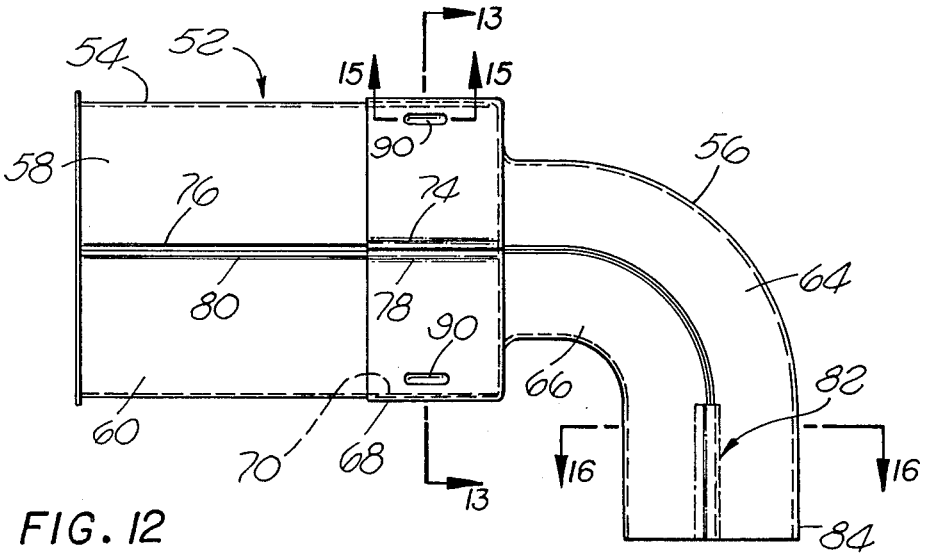
FIG. 12 is a side elevational view of an alternative form of the backshell of the present invention, having an elbow mounted on the rear of the backshell housing.

While it is preferred that the longitudinal edges 40 and 42 of the body 36 and cover 38 of the backshell housing be rolled into a substantially closed loop configuration, as seen in FIG. 10, it is also possible that the edges may have a simpler, reverse bend configuration to form the interlock 44 as illustrated in FIG. 11, but without as effective sealing and shielding as provided by the first embodiment of the invention disclosed herein. It can be seen in FIG. 10 that each edge of the body forms a loop that extends substantially completely (360°) around the center of the loop. Each edge of the cover lies against and closely outside the body edge along an angle of substantially 360° around the center of the loop.

Figure 13:
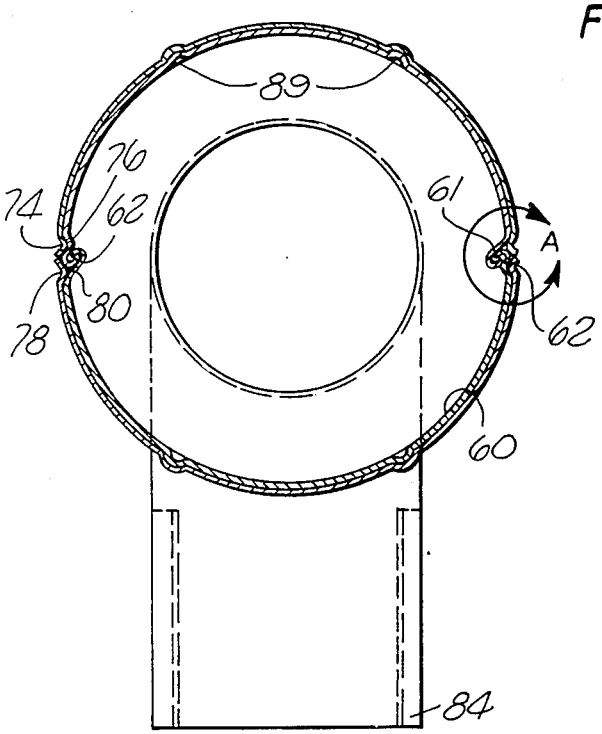
FIG. 13 is a front view of the assembly illustrated in FIG. 12.
Figure 13A:
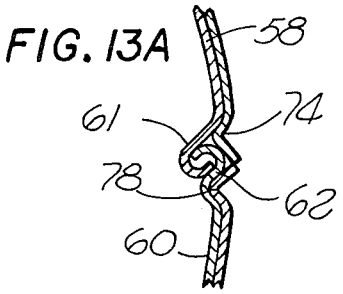
FIG. 13A is an enlarged view of a portion of FIG. 13 indicated by the arrowed circle 'A'.
Figure 15:
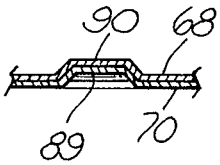
FIG. 15 is a fragmentary, longitudinal sectional view taken along line 15—15 of FIG. 12 showing a detent arrangement between the elbow and the backshell housing.
Figure 14:
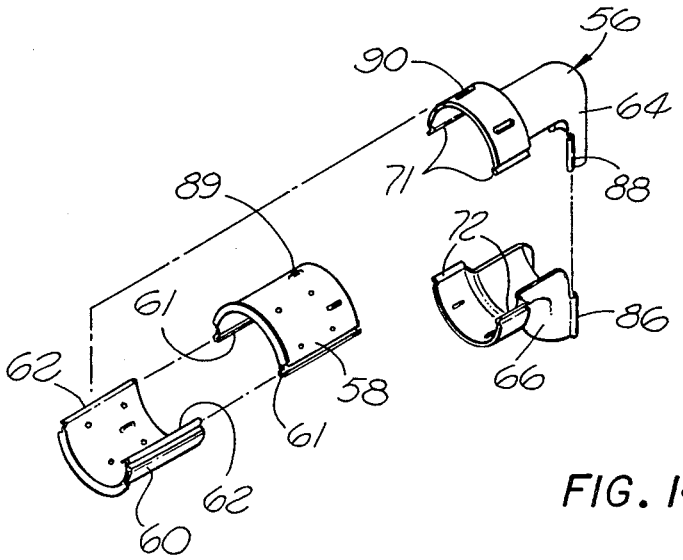
FIG. 14 is an exploded view of the assembly illustrated in FIGS. 12 and 13.

Reference is now made to FIGS. 12 to 16 which illustrate a modified form of the backshell of the present invention, generally designated 52, which includes a backshell housing 54 and an elbow 56. The housing 54 is of cylindrical configuration, and is longitudinally divided into two identical parts, which may be referred to as the upper part 58 and lower part 60. The upper part 58 embodies parallel longitudinally extending edges 60 which are reversely bent in the same direction as best seen in FIG. 13. The lower part 60 has its longitudinal edges 62 reversely bent in the same direction so that when the two parts, which are identical, are positioned with their respective formed edges aligned with each other as seen in FIG. 14, the parts may be slidably interengaged. The reversely bent edges of the parts will interlock the parts much in the fashion described in connection with the first embodiment of the invention disclosed herein, preventing the two parts from being laterally disassembled.

The elbow 46 comprises an upper half 64 and a lower half 66. The elbow 46 has an enlarged cylindrical front section 68 which is dimensioned to have a close fit around the rear 70 of the housing 54. The front cylindrical section 68 is longitudinally divided to provide parallel longitudinal edges 71 and 72 on the upper and lower halves 64 and 66 of the elbow, respectively. The edges 71 are inwardly bent as indicated at 74 so as to have a snap fit into longitudinally extending grooves 76 formed along the edges 60 of the upper part 58 of the housing 54. Likewise the edges 72 of the lower half of the elbow are inwardly bent as indicated at 78 to engage within longitudinal grooves 80 formed behind the reversely bent edges 62 of the lower part 60 of the backshell housing.

Figure 16:
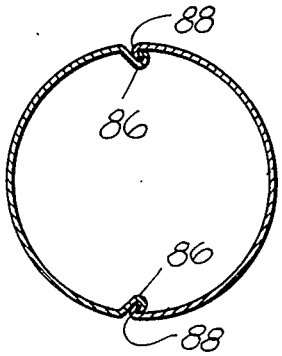
FIG. 16 is a horizontal sectional view taken along line 16—16 of FIG. 12 showing the sliding interlocking arrangement for the rear portion of the elbow.

The upper and lower halves 64 and 66 of the elbow are formed with interlocking means, generally designated 82, near the rear or lower end 84 of the elbow. Such interlocking means comprises inwardly bent vertical edges 86 on the lower half of the elbow and 88 on the upper half of the elbow as best seen in FIG. 16, which is similar to the interlocking arrangement illustrated in FIG. 11. The interlocking arrangement 82 permits vertical sliding interengagement between the upper and lower halves of the elbow, but prevents lateral disassembly of the two parts.

In order to assemble the backshell 52, initially the upper part 58 of the housing 54 is positioned relative to the lower part 60 as illustrated in FIG. 14 so that the parts may be slidably interengaged. Thereafter the upper half 64 of the elbow 56 may be pushed down over the rear 70 of the housing 54 until the inwardly bent regions 74 along the edges thereof snap into the grooves 76 formed in the housing to latch the parts together. Then the lower half 66 of the elbow is positioned below the upper half as illustrated in FIG. 14 with the reversely bent edges 86 vertically aligned with the reversely bent edges 88 so that when the lower half is pushed upwardly the respective edges 86 and 88 will slidably interengage, and interlock, and the front section of the lower half of the elbow will move up over the rear of the housing 54 until the inwardly bent regions 78 thereof snap into the grooves 80 in the housing. Thus, the upper and lower halves of the elbow become latched to the rear of the housing 54, and the rear sections of the upper and lower halves of the elbow will be firmly interlocked. It will be appreciated that the split parts of the housing 54 and elbow 56 may be assembled over a cable connected to a connector, not shown, after the contacts have been terminated to the conductors of the cable and mounted in the connector insulator. A coupling ring, not shown, which is initially threaded over the cable is then brought forwardly over the housing 54 of the backshell 52 to clamp the backshell to the connector shell in the same manner as illustrated in FIG. 1 of the drawings.

Preferably the rear portion 70 of the backshell housing 54 is formed with a plurality of circumferentially spaced outwardly extending protrusions 89, four being illustrated in FIG. 13 by way of example only. Such protrusions extend into recesses formed by outwardly extending humps 90 on the front section 68 of the elbow 56, forming a detent arrangement between the elbow and backshell housing 54 which resists rotation of the elbow on the housing and also sliding disengagement of the elbow off of the rear of the housing.

Figure 17:
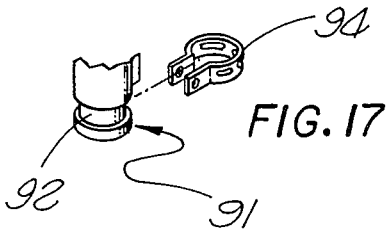
FIG. 17 is a fragmentary, exploded view showing an alternative form of the rear of the elbow and a cable clamp which may be utilized therewith.
Figure 18:
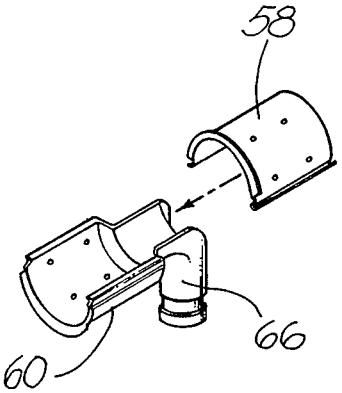
FIG. 18 is an exploded view of a further alternative form of the backshell of the present invention.

As illustrated in FIG. 17, the rear or lower end of the lower half 66 of the elbow may be provided with an extension 91 formed with an annular groove 92 therein which can receive a cable clamp 94 for tightly securing the cable to elbow 56 of the backshell assembly. Also, the lower half 66 of the elbow could be made integral with the lower part 60 of the backshell housing and the upper half 64 of the elbow eliminated so that only the upper part 58 of the backshell housing is mounted on the lower part thereof as illustrated in FIG. 18. In this case a cable clamp such as illustrated in FIG. 17, or some other fastening means, would be required for attaching the cable to the lower elbow half 66.

In each of the embodiments disclosed herein, it will be appreciated that the spring characteristic of the sheet metal (metal of constant thickness everywhere) from which the two parts of the backshell housing are formed and the formed configuration of the longitudinal edges thereof will provide the flexiblity and resiliency for interlocking and intermating of the two parts. Furthermore, environmental sealing and EMI/RFI shielding is achieved by the close interlocking fit of the formed edges of the parts. The formed configuration of the longitudinal edges of the parts can be made by stamping and metal roll forming processes, or any other fabrication technique that will provide such configuration. Thus, the more expensive casting and machine operations used for forming conventional backshells are not required by the present invention. Preferred materials for use in construction of the backshell are thin gauge stainless steel or aluminum sheet materials. Such materials will provide substantially lighter weight backshells than the present cast aluminum structures which are conventionally used, and by the use of a stainless steel material it would not be necessary to electroplate or otherwise finish the backshell to protect it against corrosion. While a metal material is preferred, and is of course required for EMI/RFI shielding, it is also possible that the backshell parts of the present invention could be formed of molded plastic.

What is claimed is:

1. A backshell adapted to be mounted onto a connector shell which may contain contacts connected to the conductors of a cable comprising:

a hollow backshell housing adapted to receive said cable therethrough;

said housing being divided longitudinally into a pair of separable parts providing two sets of adjacent longitudinally extending edges, said parts being formed of flexible material;

the edges of each said set embodying interlocking means allowing longitudinal sliding engagement of said parts but preventing lateral separation of said parts even if one or both of said parts is flexed;

said housing having a front adapted to be connected to said connector shell, and a rear;

a hollow elbow removably mounted on the rear of said housing; and said elbow being divided into separable upper and lower halves.

2. A backshell as set forth in claim 1 wherein:

said elbow has a front end mounted around the outside of said housing, and a rear end; and one of said ends embodies latching means and the other end embodies slidable interlocking means serving to hold said upper and lower halves assembled together.

3. A backshell as set forth in claim 1 wherein:

said two parts of said housing are essentially identical.

4. A backshell as set forth in claim 1 wherein:

said elbow has a front and a rear; and said front of said elbow has a configuration complementary to that of said rear of said housing so as to be slidably fit thereon.

5. A backshell as set forth in claim 4 wherein:

said upper and lower halves of said elbow are assembled laterally onto the outside of said rear of said housing.

6. A backshell as set forth in claim 5 wherein:

said front of said elbow and said rear of said housing embody latching means releasably interlocking the same.

7. A backshell as set forth in claim 6 wherein:

said upper and lower halves of said elbow at the front thereof embody two sets of adjacent longitudinally extending edges parallel to said edges of said housing parts; and said latching means comprises inwardly bent regions along said edges of said upper and lower halves of said elbow engageable with portions of said interlocking means.

8. A backshell as set forth in claim 7 wherein:

the upper and lower halves of said elbow at the rear thereof embody two sets of adjacent edges extending substantially perpendicular to said longitudinally extending edges at the front of said elbow; and the edges of each said set on the rear of said elbow embody slidable locking means.

9. A connector assembly for surrounding a cable which has a plurality of conductors with ends mounted in an insulator wherein the insulator is surrounded by a shell, comprising:

a pair of backshell housing parts, each having a pair of edges that can engage and interlock with the edges of the other part to prevent their lateral separation when interlocked around said cable while allowing longitudinal sliding of one part relative to the other, said housing parts forming a forward end and also forming an outwardly extending housing flange at said forward end which extends around substantially the entire periphery of the interlocking parts;

each of said housing parts is formed of sheet metal and has a uniform thickness, and each edge of a housing part is bent into a loop that lies within the housing so the outside of the housing is devoid of projections at the edges;

said shell has a rear end which abuts said housing flange when the housing parts are interlocked around the cable and are moved foreward against said shell rear end; and a coupling ring which mounts on said shell and which has an inwardly extending flange which abuts against a side of said housing flange opposite said shell rear end, whereby to hold said housing parts against rearward movement and against relative sliding movement that could permit their separation.

10. A connector assembly for surrounding a cable which has a plurality of conductors with ends mounted in an insulator wherein the insulator is surrounded by a shell, comprising:

a pair of backshell housing parts, each having a pair of edges that can engage and interlock with the edges of the other part to prevent their lateral separation when interlocked around said cable while allowing longitudinal sliding of one part relative to the other;

a first edge of each interlocking pair of edges forms a loop that extends substantially 360° around a center of the loop, and the second edge of the pair lies against and outside the first edge along an angle of substantially 360° around said center of said loop;

said housing parts forming a forward end and also forming an outwardly extending housing flange at said forward end which extends around substantially the entire periphery of the interlocking parts;

said shell having a rear end which abuts said housing flange when the housing parts are interlocked around the cable and are moved forward against said shell rear end; and a coupling ring which mounts on said shall and which has an inwardly extending flange which abuts against a side of said housing flange opposite said shell rear end, whereby to hold said housing parts against rearward movement and against relative sliding movement that could permit their separation.

11. A backshell adapted to be mounted onto a connector shell which may contain contacts connected to the conductors of a cable comprising:

a hollow backshell housing adapted to receive said cable therethrough;

said housing being divided longitudinally into a pair of separable parts providing two sets of adjacent longitudinally extending edges, said parts being formed of flexible material; and the edges of each said set embodying interlocking means allowing longitudinal sliding engagment of said parts but preventing lateral separation of said parts even if one or both of said parts is flexed;

each of said housing parts being formed of sheet metal, with all portions of each part having a constant thickness and being bendable;

said housing being formed so that when its parts are interlocked a cross-section of the housing is largely in the form of a circle, and said edges are bent radially inwardly so each edge forms a loop that lies within the circle formed by the outside of the housing so the outside of the housing is substantially smooth.

* * * * *